US007000521B1

(12) United States Patent
Cheng et al.

(10) Patent No.: US 7,000,521 B1
(45) **Date of Patent: *Feb. 21, 2006**

(54) PLEATED SHADE CUT-OFF METHOD AND APPARATUS

(75) Inventors: Li-Ming Cheng, Kaohsiung (TW); Lawrence S. Wu, Rowland Heights, CA (US)

(73) Assignee: ZipShade Industrial (B.V.I.) Corp., Ontario, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/850,273

(22) Filed: May 21, 2004

Related U.S. Application Data

(63) Continuation-in-part of application No. 10/306,607, filed on Nov. 27, 2002, which is a continuation-in-part of application No. 10/283,636, filed on Oct. 29, 2002.

(51) Int. Cl.
*B26D 5/08* (2006.01)

(52) U.S. Cl. ..... 83/631; 83/635; 83/636

(58) Field of Classification Search ..... 83/631, 83/635, 636; 600/407, 410; 324/309, 307, 324/318

See application file for complete search history.

(56) References Cited

U.S. PATENT DOCUMENTS

| | | | | |
|---|---|---|---|---|
| 18,918 | A | 12/1857 | Lloyd | |
| 770,131 | A | 9/1904 | Tufts | |
| 1,681,739 | A * | 8/1928 | McLaughlin | 83/468.2 |
| 1,964,457 | A * | 6/1934 | Diamond | 83/636 |
| 2,087,728 | A * | 7/1937 | Boriski | 83/629 |
| 2,486,492 | A | 11/1949 | Redman | |
| 2,546,534 | A | 3/1951 | Znidarsic | |
| 2,618,329 | A | 11/1952 | Nelson | |
| 2,624,086 | A | 1/1953 | Schaefer | |
| 2,697,487 | A | 12/1954 | Nelson | |
| 2,874,612 | A | 2/1959 | Luboshez | |
| 3,245,296 | A * | 4/1966 | Valente | 83/162 |
| 3,760,664 | A | 9/1973 | Gossling | |
| 3,798,765 | A | 3/1974 | Mattsson | |
| 4,063,355 | A | 12/1977 | Netzel | |
| 4,139,941 | A | 2/1979 | Meachan | |
| 4,146,959 | A | 4/1979 | Hopper | |
| D255,642 | S | 7/1980 | Erpenbeck | |
| 4,403,415 | A | 9/1983 | Kufrin | |
| 4,673,018 | A | 6/1987 | Judkins | |
| 4,944,205 | A | 7/1990 | Ricci | |
| 5,103,699 | A | 4/1992 | Brown | |
| 5,158,127 | A | 10/1992 | Schumacher | |
| 5,339,716 | A * | 8/1994 | Sands et al. | 83/452 |
| 5,918,656 | A | 7/1999 | Daniels et al. | |

(Continued)

*Primary Examiner*—Allan N. Shoap
*Assistant Examiner*—Carolyn Blake
(74) *Attorney, Agent, or Firm*—William W. Haefliger

(57) ABSTRACT

The method of cutting a pleated shade to selected length, said shade having pleats retained in pleated condition between longitudinally elongated first and second retainers, that includes the steps providing a blade having a cutting edge, orienting the blade to extend laterally relative to the retainers and/or pleats, with the blade edge presented toward the first retainer at an angle to that retainer, and urging the blade in a first direction toward the first retainer so that the blade edge cuts through the first retainer progressively in a lateral and second direction, and progressively laterally through the pleats and lower retainer, the pleats and/or retainers being adjustably laterally confined, and the first retainer and pleats being clamped in said first direction at the locus of cutting, by force transmission from the blade.

15 Claims, 9 Drawing Sheets

U.S. PATENT DOCUMENTS 5,943,778 A 8/1999 Alana
5,947,176 A 9/1999 Judkins
6,049,984 A * 4/2000 McGehee ..... 30/113
6,059,004 A 5/2000 Oskam
6,131,640 A 10/2000 Judkins
6,435,066 B1 * 8/2002 Kutchmarek et al. ..... 83/29
6,671,962 B1 1/2004 Watamura

* cited by examiner

FIG. 11.
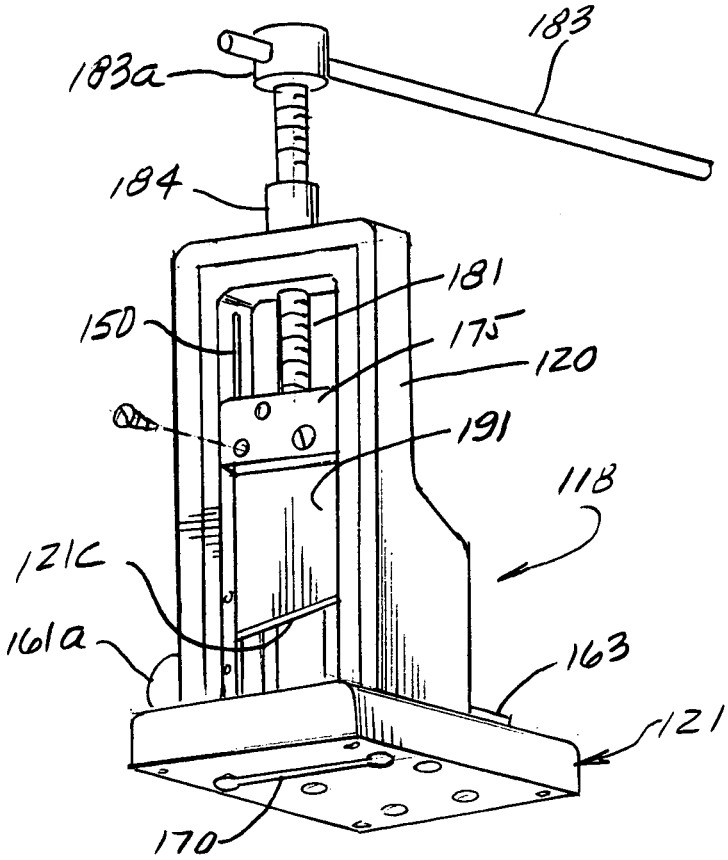
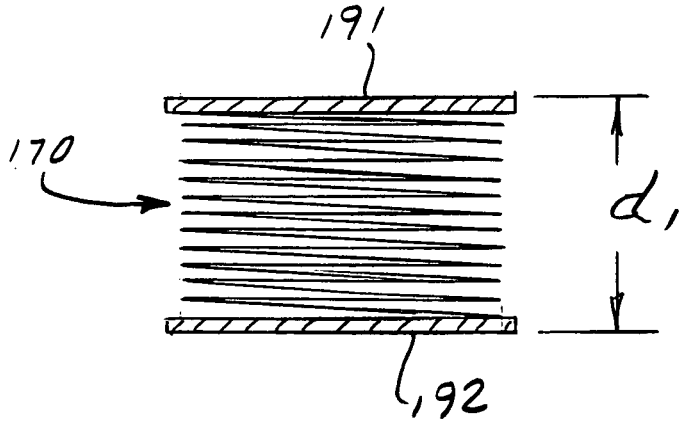
FIG. 12

PLEATED SHADE CUT-OFF METHOD AND APPARATUS

This application is a continuation-in-part of pending application Ser. No. 10/306,607, filed Nov. 27, 2002, which is a continuation-in-part of pending U.S. application Ser. No. 10/283,636, filed Oct. 29, 2002.

BACKGROUND OF THE INVENTION

This invention relates generally to provision of pleated shades to selected length, and more particularly to cutting such shades to required width, for example to conform to width of a window or window frame.

In the past, window shades have been marketed with predetermined width. There was no easy way to conform the widths of such shades to windows or window frames of different sizes at the time of shade installation. This problem has become particularly acute for pleated shades characterized by expansible pleats retained between upper and lower shade slats. Lateral movement of such pleats, in an unstable stack of such pleats, during cutting, complicates the cutting task, particularly for an unskilled person or customer, who attempts to cut through shade slats and pleats.

SUMMARY OF THE INVENTION

It is a major object of the invention to provide a method and apparatus meeting the above need. The basic method of the invention for cutting a pleated shade to selected width, as at the time of installation, when a window or frame size is determined, includes the steps a) providing a blade having a cutting edge, b) orienting the blade to extend laterally relative to the slats and pleats, with the blade edge presented with predetermined angularity toward the first slat, c) and urging the blade in a first direction toward the first slat so that the blade edge cuts through the first slat progressively in a lateral and second direction, and progressively laterally through the pleats and lower slat, the pleats and slats being laterally confined, and the first slat and pleats being clamped in said first direction at the locus of cutting, by force transmission from the blade.

Typically, the first slat and pleats are locally displaced in said first direction at the locus of cutting. Also other slats and pleats are typically held in fixed position longitudinally or widthwise, during said cutting, to assure precision of cutting.

A further object includes effecting such retention by providing two guides extending in generally parallel relation to the first direction, inserting the blade slats and pleats into cutting position between said guides and in close relation thereto, and holding the projecting extent of the assembly in that position during cutting. In this regard, the guides are advantageously also used to guide blade travel in that first direction, and during cutting, to maintain blade predetermined angularity.

An added object is to provide a cross-member extending between the guides to be guided in said first direction to travel therealong, and supporting the blade to project from said cross member toward the first slat, the blade having edge portions guided by the two guides. A pusher is typically connected to the cross-member to urge the cross-member and blade toward the first slat.

For superior results, the blade edge is typically provided with angularity maintained relative to the first slat, and at an angle between 100 and 300.

Further, and in accordance with apparatus of the invention, such apparatus typically includes a) a blade having a cutting edge, b) means for orienting the blade to extend laterally relative to the slats and pleats, with the blade edge presented toward the first slat at a predetermined angle to that slat, c) and means for urging the blade in a first direction toward the first slat so that the blade edge cuts through the first slat progressively in a lateral and second direction, and progressively laterally through the pleats and second slat, with the pleats laterally confined, and the first slat and pleats being clamped in said first direction at the locus of cutting by force transmission from the blade.

Another object is to provide a clamping member located between uprights guides, there being a clamping force transmitting screw extending through one of the guides and acting to transmit clamping force to said member.

A further object is to provide a removable support platform in position between the guides to support the pleats and/or slats.

A yet further object is to provide a base supporting the guides and the platform, there being a groove associated with the base to interfit and guide a downward projection associated with the support platform, whereby the platform can be accurately positioned relative to and beneath the blade.

As will be seen, a slot may be provided in the base in registration with the blade to pass the blade for removal and replacement.

The slot is typically in registration with the blade, to pass the blade for removal, said slot intersecting said groove.

An added object is to provide a cross member extending between upright guides to be guided for travel in a downward direction, and removably supporting the blade to project from cross member toward the slat and or pleats to be cut.

As will be seen, threaded fasteners connect the blade and cross member, enabling downward removal of the blade.

These and other objects and advantages of the invention, as well as the details of an illustrative embodiment, will be more fully understood from the following specification and drawings, in which:

DRAWING DESCRIPTION

Figure 3:
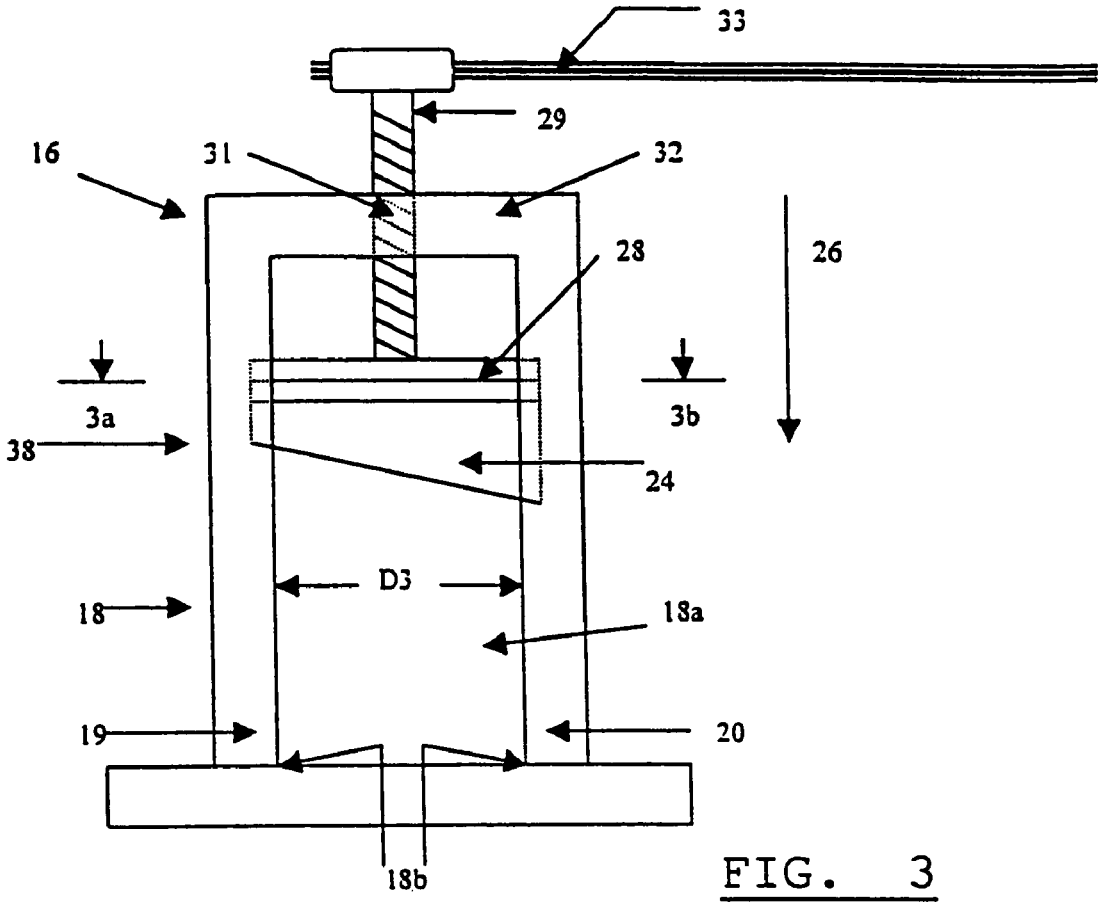
FIG. 3 is an elevation showing shade confining and cutting apparatus.
Figure 3A:
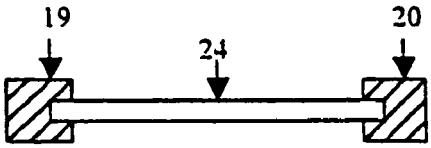

FIG. 3*a* is a section taken on lines 3*a*—3*a* of FIG. 3.

Figure 4:
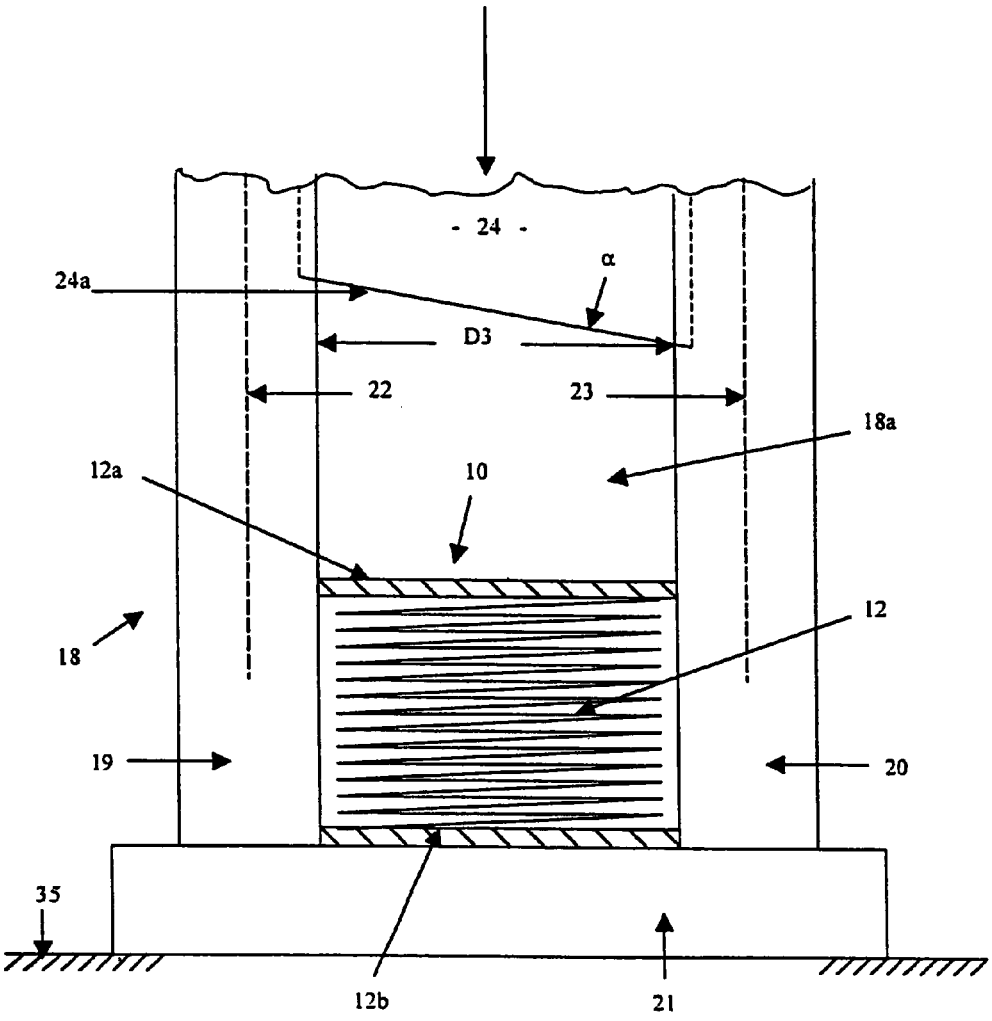
Figure 5:
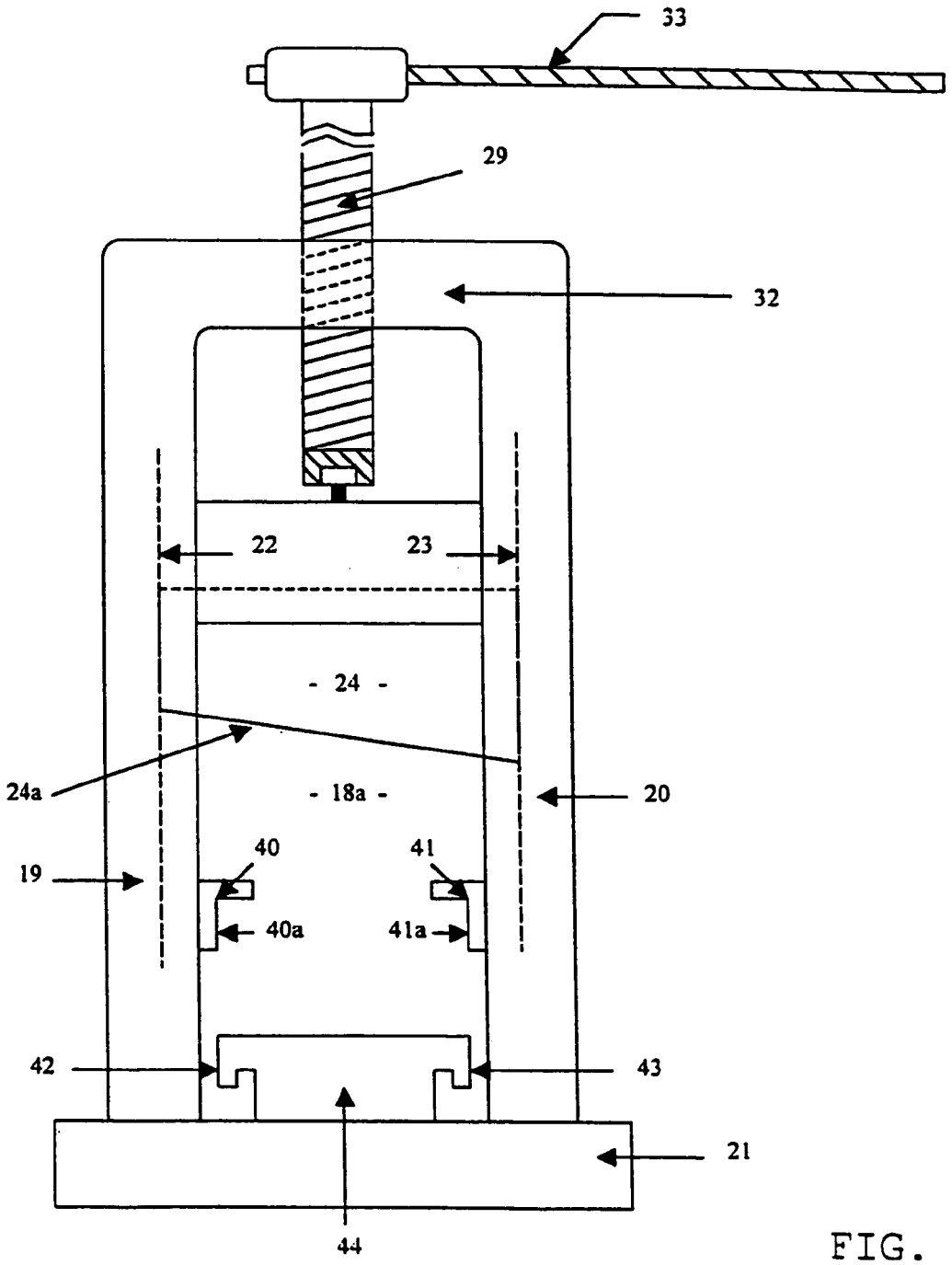
Figure 6:
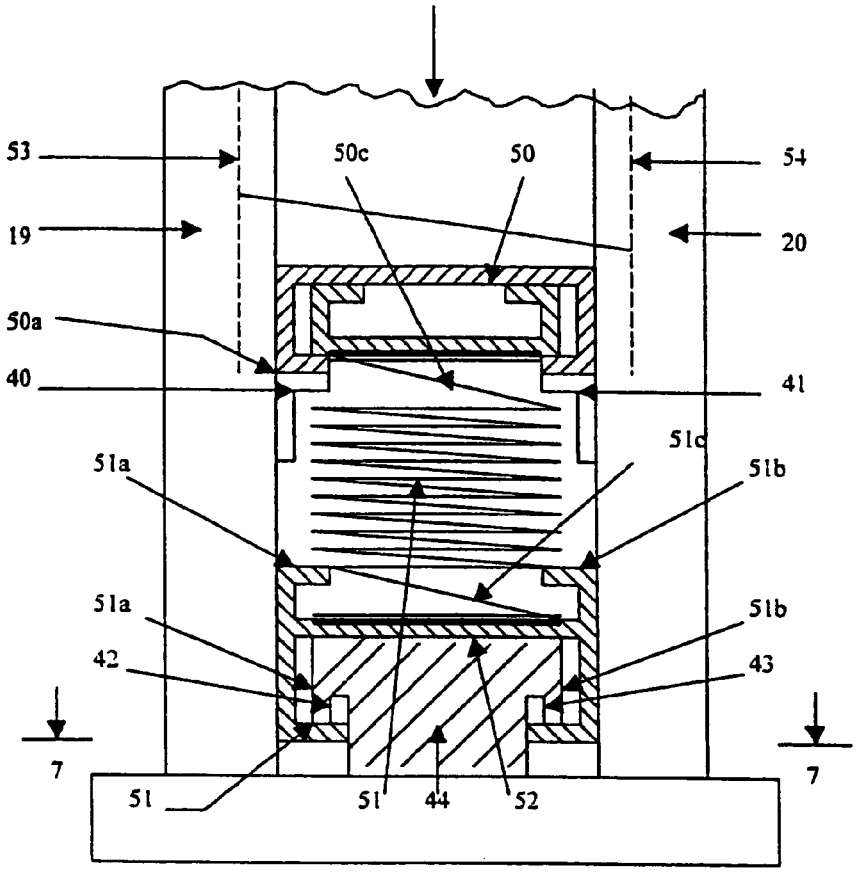
Figure 7:
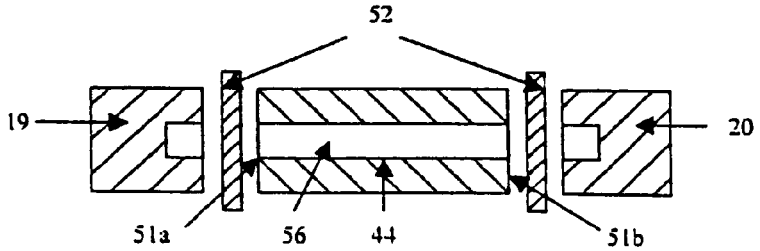
Figure 8:
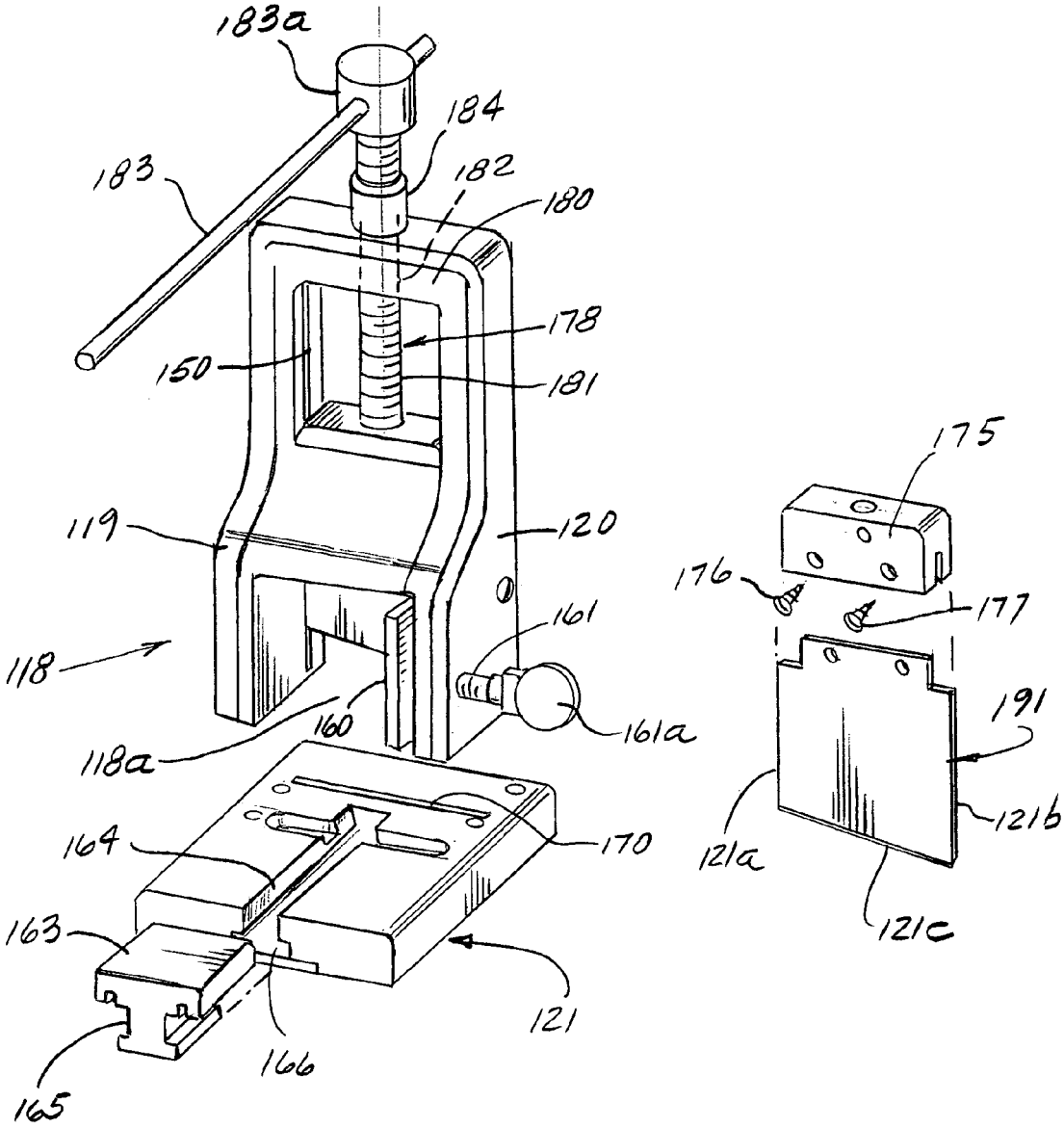
Figure 10:
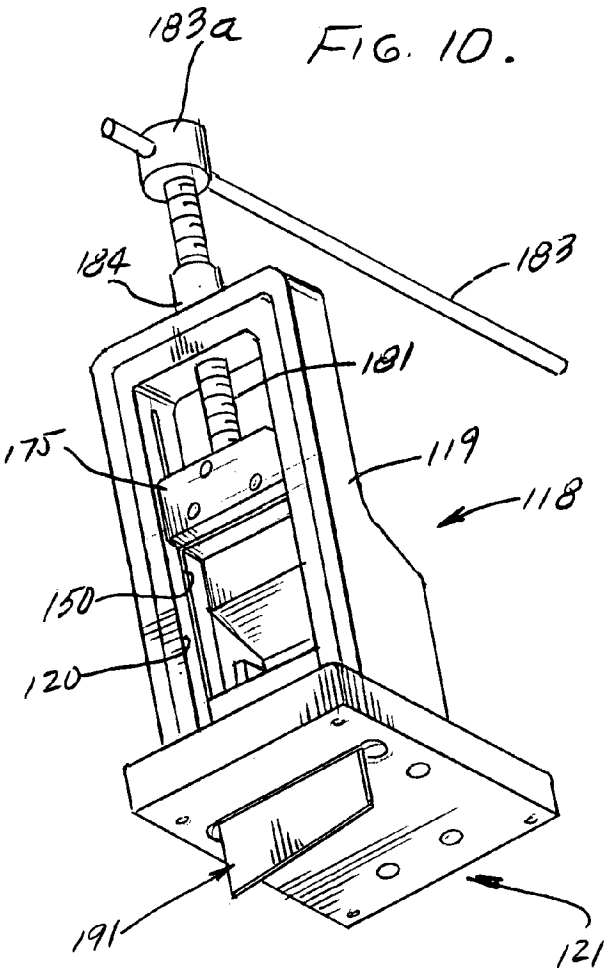
Figure 9:
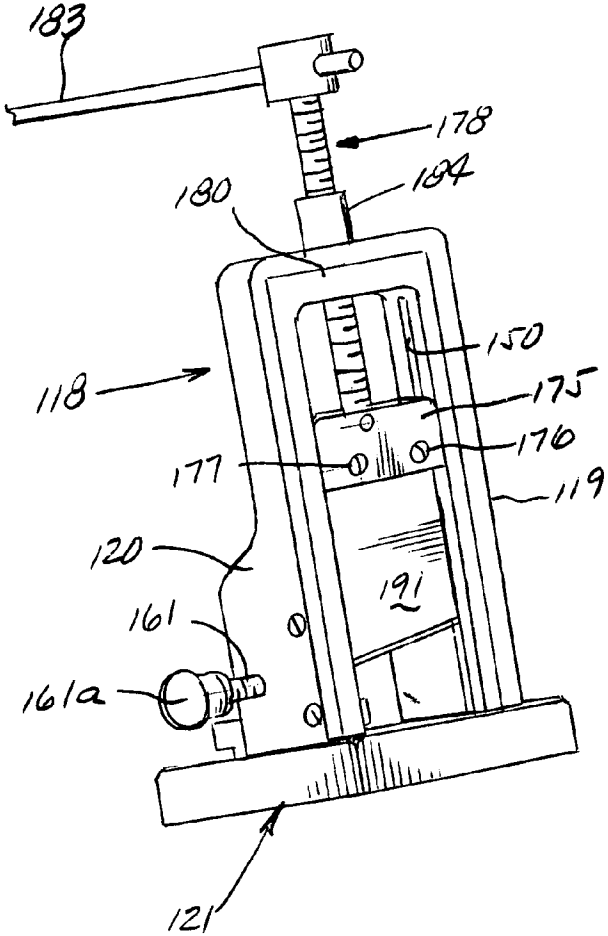

FIG. 4 is an enlarged fragmentary view showing shade slats and pleats laterally confined by the apparatus of FIG. 3, and positioned for cutting;

FIG. 5 is a view of modified shade assembly cutting apparatus;

FIG. 6 is a view showing confinement and positioning of a modified shade assembly, by the FIG. 5 apparatus;

FIG. 7 is a section taken on lines 7—7 of FIG. 6;

FIG. 8 is a perspective view of a modification;

FIGS. 9–11 are further perspective views of the FIG. 8 device, and

Figure 13:
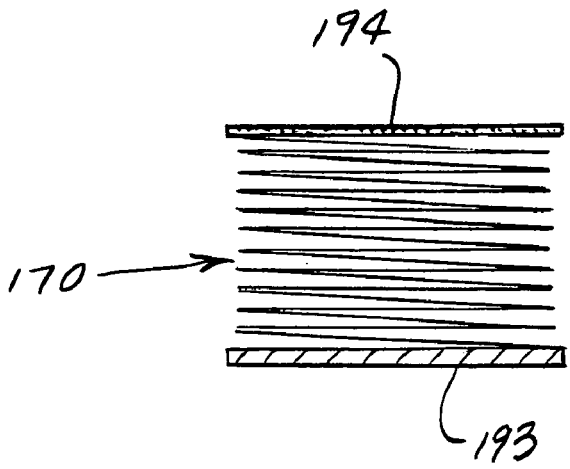
Figure 14:
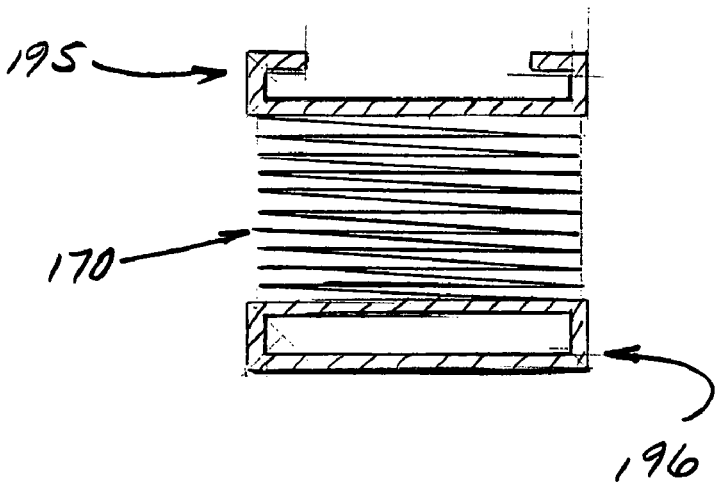

FIGS. 12–14 are end views of various forms of shades to be cut by the FIG. 8 device.

DETAILED DESCRIPTION

Figure 1:
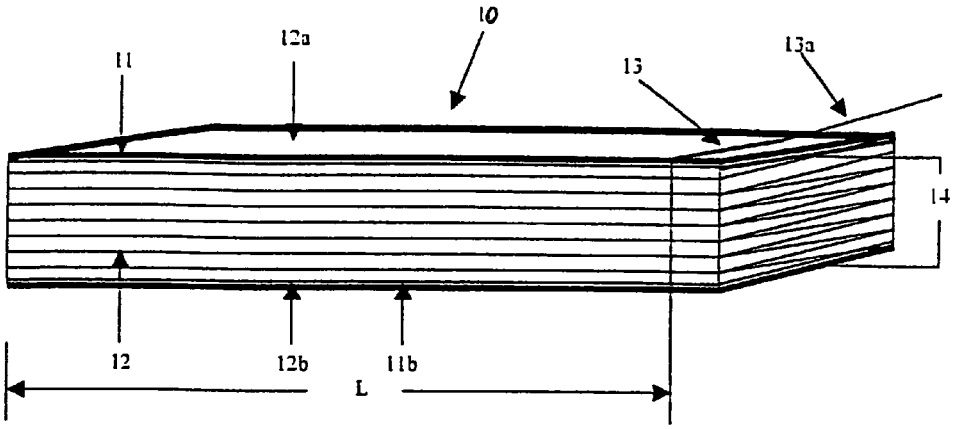
FIG. 1 is a perspective view showing a shade having slats and pleats.
Figure 2:
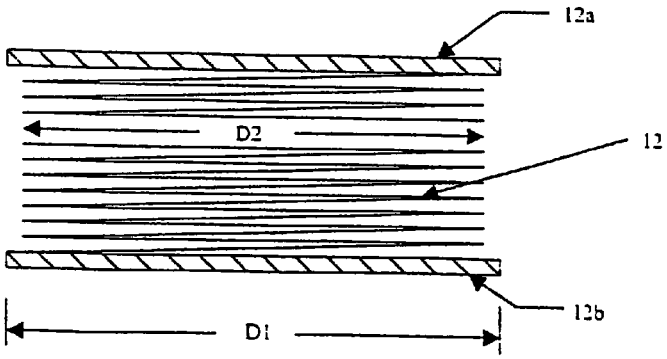
FIG. 2 is an enlarged end view of the FIG. 1 shade.

In the drawings, a typical window shade longitudinally i.e. widthwise extending assembly is shown at 10, and includes a shade 11 in the form of pleats in a stack 12, and retained vertically between upper and lower slats 12*a* and 12*b*. See FIGS. 1 and 2. It is desired to cut the assembly, as for example at a selected mark point 13, in a plane 13*a* normal to the assembly axis 14, corresponding to desired width L of the shade. (Shade "width" is in the elongation direction of the shade). The shade folded pleats may consist of plastic (synthetic resinous) material or paper, and the slats may consist of wood, plastic or metal.

In accordance with the invention, preferred apparatus 16 is provided for severing to selected width the assembly 10. That apparatus as seen in FIG. 3 includes a holder, as for example the holder seen at 18, for supporting the shade assembly during progressive cutting, to be described. Holder 18 defines U-shaped channel 18*a* with lower corners 18*b*, to receive the shade. Corners 18*b* may extend at or approximately 900. Channel 18*a* may be slightly larger in width $D_3$ than the lateral dimensions $D_1$ of the slats and $D_2$ of the pleats, so as not to interfere with insertion of the assembly 10 through the channel, to a position for severing or cutting in plane 13*a*. See FIG. 4, showing the assembly 10 inserted through the channel into cutting position. Note that holder uprights 19 and 20 are spaced apart to closely retain the shade assembly so as to block sideward slippage of the slats and pleats out of position, as during forcible cutting. The uprights are rigidly mounted on a base 21, and define laterally spaced vertical guide slots 22 and 23 for guiding edges of a cutting blade 24 that moves vertically to cut through the assembly 10.

The blade is oriented to extend laterally relative to the slats and pleats in the assembly 10, with blades edge 24*a* presented toward the first slat 12*a* at an angle $\alpha$ relative to that slat, where a is between 10° and 30°, for best results.

Means is provided for urging the blade in a direction toward the first slat so that the blade edge cuts through the first slat progressively in a lateral and second direction, and progressively laterally through the pleats and lower slat, the pleats and slats being laterally confined, and the first slat and pleats being clamped in said first direction at the locus of cutting, by force transmission from the blade. Such means may advantageously include a cross member 28 extending between uprights 19 and 20 acting as guides, whereby the cross member is guided in said first direction 26 and carries or supports the blade to project from the cross-member downwardly toward the first slat. The member 28 is urged downwardly, with mechanical advantage, by a manually rotated screw 29 thread connected at 31 to a fixed cross-piece 32 extending between the uprights 19 and 20. A handle 33 on the screw is manually rotated to rotate the screw for driving or pushing the cross-member 28 and blade downwardly, to cleanly cut through the slats and pleats. In this process, the first slat 12*a* and the pleats 12 are locally displaced i.e. compressed in direction 26, at the locus 13*a* of lateral and downward cutting; also the slats and pleats at that locus are retained in fixed position, laterally, i.e. in the second direction 38, as by one or both uprights 19 and 20, and are also retained in fixed position longitudinally by the operator's gripping of the assembly 10 proximate the holder 18 and base 21. The base and the projecting extent of the assembly 10 are typically supported on a surface 35 during such cutting. Accordingly, the guides 19 and 20 serve to guide both the cross-member 28 and the blade 24, they serve to retain the assembly 10 in laterally oriented and stacked relation during compressive cutting acting to urge the slats and pleats downwardly and laterally, and they support the cross-piece 32 and screw (i.e. pusher) 29 during screw rotation and downward pushing of the cutting blade. Also, the blade is confined between the uprights in such a way as to minimize the danger of cutting the fingers of the user. Blade 24 is easily retracted upwardly, as by reverse rotation of the screw after the cutting completion.

FIGS. 5 and 6 show similar apparatus, with corresponding parts bearing the same numerals. In addition, longitudinal guide elements, as at 40, 41, 42 and 43 are provided to project longitudinally (normal to the plane of FIG. 5) into the U-shaped channel 18*a* at upper and lower locations as shown. Elements 40 and 41 project laterally oppositely, and elements 42 and 43 project downwardly in parallel, laterally spaced relation. Elements 40 and 41 are carried by supports 40*a* and 41*a* attached to the uprights, and elements 42 and 43 are carried by a support 44 attached to the base 21.

FIG. 6 shows elements 40 and 41 slidably longitudinally engaging the under surfaces 50*a* of an upper slat 50, which may be of plastic or metallic and channel shaped, and elements 42 and 43 guidably longitudinally received in longitudinally extending recesses 51*a* and 51*b* defined by a lower slat 51, which may also be of plastic or metallic and channel shaped. Pleats 51 extend between the upper and lower slats 50 and 52, and are suitably connected to those slats as at 50*c* and 51*c*. The pleats may consist of thin plastic or paper sheet material, with folds at laterally spaced locations. Slat 51 has flanges 51*a* and 51*b* supporting the pleats.

The vertical grooves 53 and 54 in the upright guides are extended into the elements 40, 41, 42, 43, as in plane 13*a*, to pass the blade during cutting. A similar groove 56 is provided in support 44. See FIG. 7.

Referring now to the sturdy preferred device of FIGS. 8–11, it is typically metallic, and includes a holder 118 for supporting the shade assembly for cutting. Holder includes upright guides 119 and 120 rigidly mounted on a base 121. This assembly provides a channel 118*a* for endwise reception of a shade assembly to be cut or severed.

Upright guides 119 and 120 are laterally spaced apart as shown, and means is provided for laterally clamping the pleats and/or slats received or positioned between the guides. For this purpose, a clamping member 160 is located between the guides, and a lateral screw 161 is carried by guide 120 for transmitting clamping force laterally to the member 160, which may advantageously have a plate form to engage the side of the shade assembly. Screw 161 has a handle 161*a*, and may have threaded interfit with guide 120. In this way various width shade assemblies may be firmly clamped between the guides, for precision cutting.

A removable support platform may be provided, as shown at 163, to extend between the guides to support a shade assembly for clamping. That platform is typically slidably and forwardly mounted into position on the base 121, as via a guide groove 164 sunk in the base for purposes as will appear. The platform may have a depending tongue 165 with T-shape for interfit at 166 in the groove, to guide forward and rearward travel of the platform, relative to the base. For shade assemblies of greater vertical dimension (see $d_1$ in FIG. 12), the platform may be removed. The platform width $w_1$ is reduced at the side adjacent the clamping plate 160, to obviate interference with that plate during lateral travel of plate 160.

A vertical and laterally extending slot 170 is provided in the base in registration with blade 191, to downwardly pass the blade, for removal and/or replacement. At that time, the platform 163 is retracted, as referred to above, to expose the slot 170 to pass the blade. See FIG. 10. Slot 170 may intersect the groove 164, as shown, for compactness of the assembly.

The opposite edges 121*a* and 121*b* of the blade are slidable in grooves 150 in the uprights or guides 119 and 120, as the blade 191 is forced downwardly to cut the shade assembly. A cross member or cradle 175 extends laterally between the guides and is connected to the blade as by two threaded fasteners such as screws, 176 and 177. See FIG. 9. This allows blade disconnection for downward removal, as referred to above, for replacement. The edges of the cross member may also be slidable in the grooves in the uprights. FIG. 11 shows installation of a new blade upwardly through the slot 170.

A pusher 178 is operatively connected to the cross member to urge the cross member and blade toward the top of the shade assembly.

Preferably, the pusher is provided in the form of a screw 181 threadably carried at 182 by a lateral support 180 that interconnects the tops of the guides 119 and 120. As the screw 181 is turned by handle 183, the blade is displaced downwardly to cut or sever the shade assembly. Note angled blade lower edge 121*c*. A stop ring 184 is provided on the screw to limit downward displacement of the screw and blade. For this purpose, a hub 183*a* on the handle, fastened to the screw, engages ring 184 and presses it downwardly on support 180 to stop screw and blade travel.

FIGS. 12–14 show three different forms of collapsed shade assemblies that can be quickly severed by the FIG. 8 apparatus. Note pleats 170 in each, top and bottom retainers such as slats 191 and 192 in FIG. 12; bottom slat 193 and top sticker 194 in FIG. 13; and top and bottom retainers such as housings 195 and 196 in FIG. 14.

The slats are typically wooden, and the housings 195 and 196 are of molded plastic.

We claim:

1. The method of cutting a pleated shade to selected length, said shade having elongated pleats retained in pleated condition between longitudinally elongated first and second retainers, extending generally parallel to the pleats that includes the steps a) providing a blade having a cutting edge, b) orienting the blade to extend laterally relative to the retainers and pleats, with the blade edge presented toward the first retainer at an angle to that retainer, c) urging the blade in a first direction toward the first retainer so that the blade edge cuts through the first retainer progressively in a lateral and second direction, and progressively laterally through the pleats and lower retainer, the pleats and/or retainers being adjustably sidewardly and laterally confined by provision of an adjustable clamping member between two guides, and the first retainer and pleats being clamped in said first direction, by force transmission from the blade, d) providing a support platform between two blade guides to support said pleats and/or retainers, e) providing a base supporting said guides and said platform, there being a groove associated with the base to interfit and guide a downward projection carried by the support platform, whereby the platform can be accurately positioned relative to the blade, f) providing a through slot in the base in registration with the blade to pass the blade for removal and replacement, g) sliding the platform and said downward projection relative to the base and groove, and slot, and from a forward position in which the platform extends over the slot, and to a retracted position in which the slot is exposed to pass the blade, the platform having reduced lateral width to obviate interference with the clamping member, in a platform forward position, h) and downwardly removing the blade through the slot in the base, while the platform is in said retracted position.

2. The method of claim 1 wherein the pleats and/or retainers are laterally confined by providing said two guides extending in generally parallel relation to said first direction, and inserting the blade into cutting position between said guides and in close relation thereto, and laterally clamping blade pleats and retainers in position between said two guides.

3. The method of claim 2 wherein said clamping is effected by providing a clamping force transmitting screw extending through one of the guides and acting to transmit clamping force to said member.

4. The method of claim 2 including providing a slot in the base in registration with the blade, to pass the blade for removal, said slot provided to intersect said platform guide groove, in the base.

5. The method of claim 4 including providing a cross member to extend between the guides to be guided for travel in said first direction, and removably supporting the blade to project from the cross member toward the retainers and/or pleats.

6. The method of claim 5 including providing a threaded fastener or fasteners removably attaching the blade to the cross-member.

7. The method of claim 5 including providing a pusher operatively connected to the cross member to urge the cross member and blade toward a retainer.

8. The method of claim 1 wherein said blade has edge angularity maintained relative to an uppermost retainer, and at an angle between 10° and 30°.

9. The method of claim 7 wherein the pusher is provided in the form of a screw threadably carried by a lateral support associated with the guides.

10. The method of claim 9 including providing a stop associated with the lateral support to limit displacement of the screw, thereby limiting displacement of the blade relative to the retainers and/or pleats.

11. The method of claim 10 wherein said stop is provided in the form of a ring extending about the screw.

12. The method of claim 1 wherein said base, and guides consists of metal.

13. The method of claim 5 including detaching the blade from the cross member, and passing the blade downwardly through the base, for removal.

14. The method of claim 9 including rotating the screw to cause the blade to cut through the retainer and/or pleats at a selected location along their lengths.

15. The method of claim 1 including locating said slot in the base to be in registration with the blade, to pass the blade for removal, said slot located to intersect said platform guide groove formed in the base.

* * * * *